United States Patent [19]

Rowling

[11] 4,193,498

[45] Mar. 18, 1980

[54] MULTIPLE BOOKLET AND METHOD OF MAKING THE SAME

[75] Inventor: Sidney Rowling, Wynnewood, Pa.

[73] Assignee: Spot-O-Gold Corporation, Philadelphia, Pa.

[21] Appl. No.: 897,873

[22] Filed: Apr. 19, 1978

Related U.S. Application Data

[63] Continuation-in-part of Ser. No. 662,749, Mar. 1, 1976, which is a continuation of Ser. No. 541,307, Jan. 15, 1975, abandoned.

[51] Int. Cl.[2] ..... B65D 75/40; B42D 1/00

[52] U.S. Cl. ..... 206/494; 206/232; 206/820; 281/16; 229/92.1

[58] Field of Search ..... 206/494, 449, 820, 460, 206/232; 281/16, 17, 21 R, 15 R; 282/11.5 R; 229/92.1

[56] References Cited

U.S. PATENT DOCUMENTS

| | | | |
|---|---|---|---|
| 3,347,361 | 10/1967 | Lindeke | 206/460 |
| 3,920,267 | 11/1975 | Lyon, Jr. | 281/16 |

*Primary Examiner*—William T. Dixson, Jr.

*Attorney, Agent, or Firm*—Seidel, Gonda, Goldhammer & Panitch

[57] ABSTRACT

A thin lightweight strip of booklets and method of making the same are disclosed. The booklets are comprised of one elongated sheet folded in thirds, then in half, then in half to define pages of the same size without the use of fasteners. The booklets are connected end to end to form a strip which is separable along perforation lines. The strip of booklets has a fold line between and adjacent the free ends of said sheet along one edge of said strip and only fold lines along the opposite edge of said strip. The strip of booklets is adapted to be sealed within an envelope.

10 Claims, 6 Drawing Figures

FIG. 1
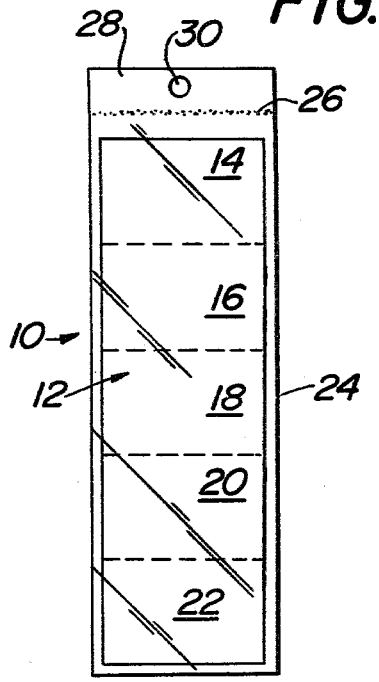
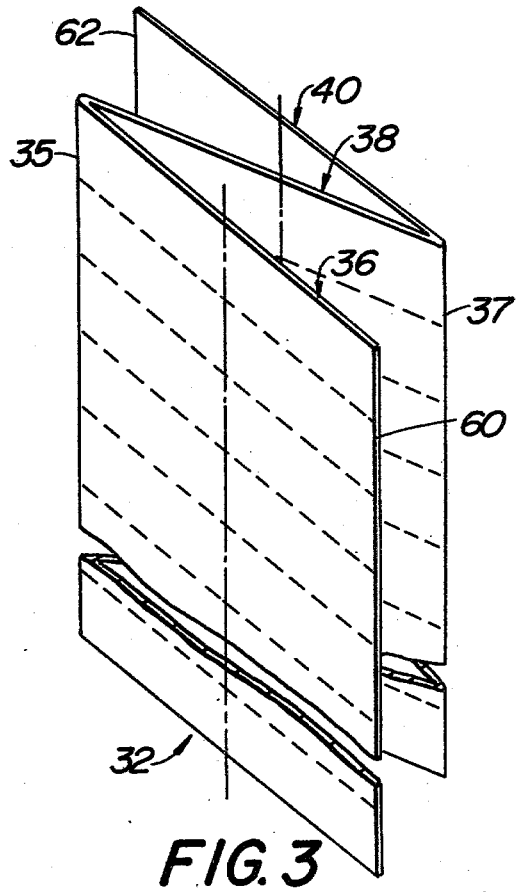
FIG. 3
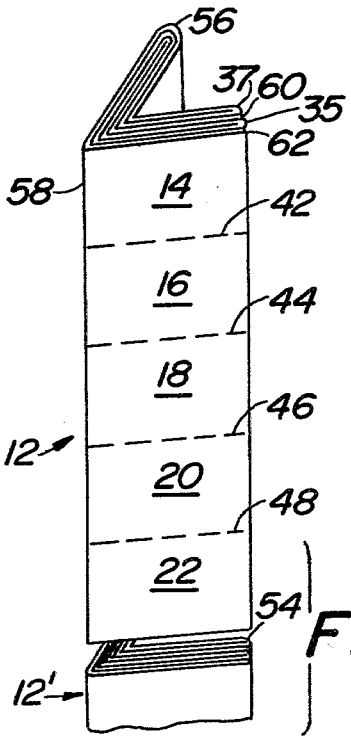
FIG. 6

FIG. 4
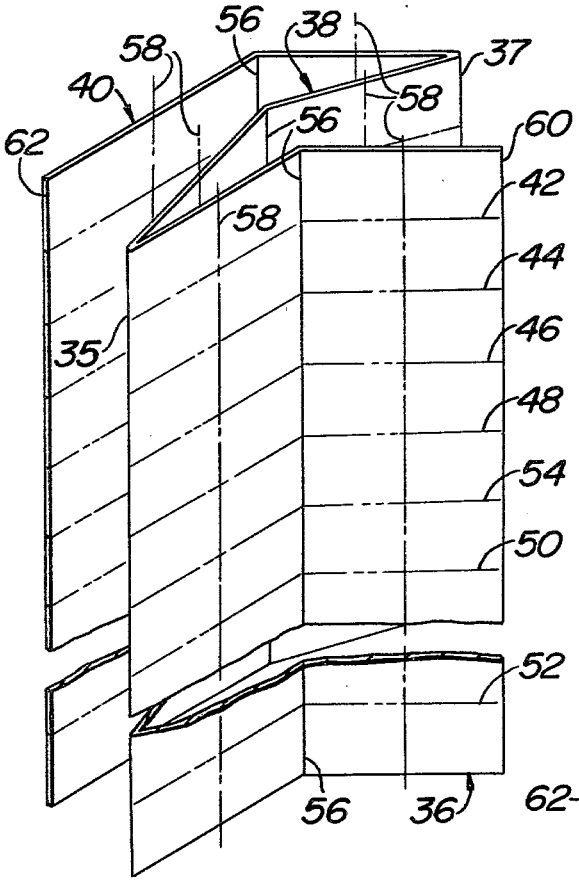
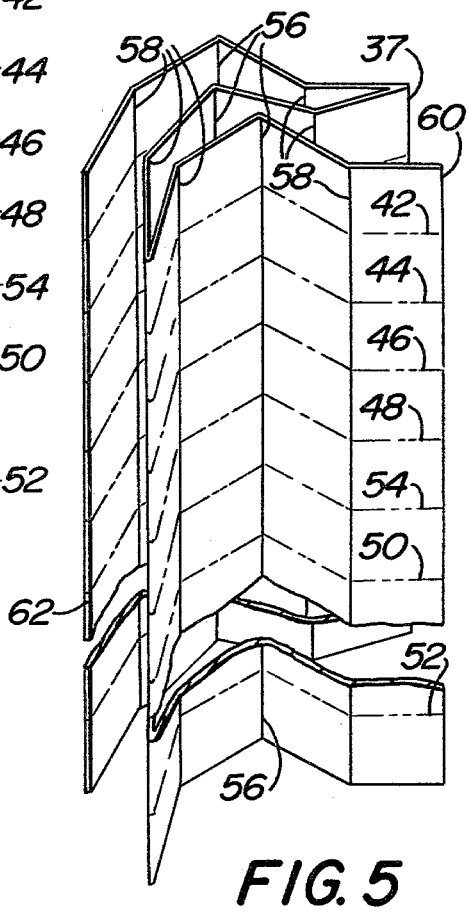
FIG. 5

MULTIPLE BOOKLET AND METHOD OF MAKING THE SAME

RELATED CASE

This application is a continuation-in-part of my copending application Ser. No. 662,749 filed Mar. 1, 1976 for "Booklet And Method Of Making The Same", which application is a continuation of application Ser. No. 541,307 of the same title and filed Jan. 15, 1975 now abandoned.

BACKGROUND

The conventional booklet is comprised of a plurality of pages adhesively or mechanically connected together by a fastener. A booklet formed in that manner is objectionable from the viewpoint of cost as well as thickness. As a result thereof, booklets constructed in a conventional manner are not readily adapted for use as a premium as compared with the present invention. A premium is a product which is given away for purposes of advertising, as included within a box of cereal, etc. As a premium, the prime considerations are size and weight in addition to cost.

The booklets of the present invention are also adapted for other uses in addition to premiums. Thus, the booklets may be what is conventionally termed comic books and may be used for maps, etc. The booklets produced in accordance with the above-mentioned applications are preferably small in size such as 3 inches by 2¼ inches. When packaging a plurality of such small booklets in a bag, they gravitate to the bottom of the bag, intermingle with one another and are unattractive from a packaging viewpoint due to the fact that only the outermost booklet is visible through a transparent portion of the bag. The present invention solves that problem.

SUMMARY OF THE INVENTION

The present invention is directed to a strip of booklets having only fold lines along one edge and which is free from any fasteners. The strip of booklets has two free edges and fold lines along the opposite edge. The booklets are connected end to end but are separable by perforation lines. The perforation lines include slits which are substantially longer than the length of the interconnecting tabs.

The method of the present invention comprises the steps of printing a plurality of rows of imprints on an elongated paper sheet, folding said printed sheet transversely into thirds in a manner so that a third of said sheet at one end overlies one face of the middle third of the sheet and the remaining third of the sheet is juxtaposed to the opposite face of the middle third of the sheet. Then the three layers of the thusly folded sheet are perforated between said rows of imprints with perforation slits substantially longer than the integral tabs. Then the thusly folded perforated sheet is folded in half, and then is folded in half again to thereby provide a strip of booklets interconnected by said integral tabs with pages of the same size without the use of fasteners and only fold lines along one edge thereof. The thusly folded strip of booklets is then inserted into an envelope and the envelope is sealed.

The present invention is directed to a solution of the problem of how to improve the appearance of a package containing a plurality of booklets. The solution includes the concept that the booklets should remain interconnected as a strip while being readily separable. In this manner, a portion of each booklet will be visible through a transparent envelope in which the strip is packaged. The booklets of the strip are delineated by transverse perforation lines.

Due to the number of pages in the booklet, it is not possible to readily separate the booklets from one another if the perforation lines are of the type used on a checkbook for interconnecting the check with the stub. A perforation line is a line of slits spaced from one another by integral tabs. I have found that the slits should have a length which is about 6 times the length of the tab when the booklet is comprised of 12 layers of paper. When the booklets are interconnected by perforation lines in this manner, they are readily separable by children and grownups alike.

It is an object of the present invention to provide a solution to the packaging problem associated with packaging a plurality of small booklets in a single envelope or bag.

Other objects will appear hereinafter.

For the purpose of illustrating the invention, there is shown in the drawings a form which is presently preferred; it being understood, however, that the invention is not limited to the precise arrangements and instrumentalities shown.

FIG. 1 is a plan view of a packaged strip of booklets in accordance with the present invention.

FIG. 3 is a perspective view of the sheet shown in FIG. 2 after a first folding step.

FIG. 4 is a perspective view of the sheet after the second folding step.

FIG. 5 is a perspective view of the sheet after a subsequent folding step.

FIG. 6 is a perspective view of the completed booklet after a slitting step.

Figure 2:
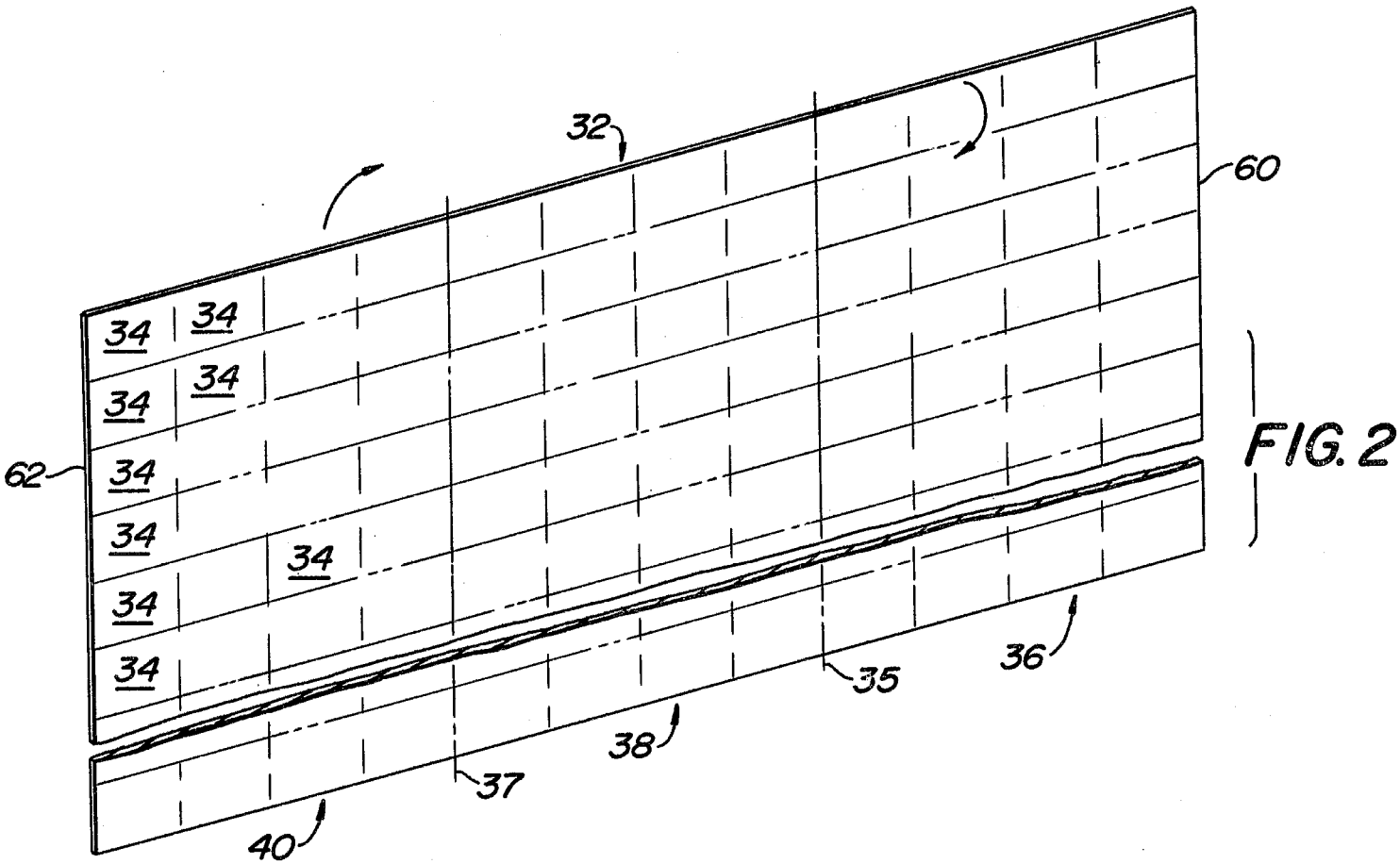
FIG. 2 is a perspective view of a sheet having rows of printed images thereon and before the folding step.

Referring to the drawings in detail, wherein like numerals indicate like elements, there is shown in FIG. 1 a package comprising a strip of booklets designated generally as 10. The package 10 includes a bookstrip 12 comprised of booklets 14, 16, 18, 20 and 22 connected end to end and disposed within an envelope 24 which is transparent on at least one major face. The envelope 24 is preferably made from a transparent polymeric plastic material sealed across its open end by the heat seal 26 thereby defining the tab 28. Seal 26 need not be a heat seal but could be an equivalent such as staples. Tab 28 may have a hole 30 therethrough to facilitate display of the package 10 on a pegboard or the like.

Referring to FIG. 2, there is illustrated a printed sheet 32 having rows of images 34 printed on both faces thereof. The images are preferably different from one another and printed parallel to the long edge of the sheet. For purposes of illustration, 10 rows of images are printed on sheet 32 whereby each bookstrip 12 will be comprised of 5 booklets. A greater or lesser number of booklets may be interconnected to form a bookstrip.

After the sheet 32 has been printed with 10 rows of images on both faces thereof, it is folded in thirds along the fold lines 35 and 37. See FIG. 3. The ends of the sheet 32 are designated as 60 and 62. The middle third of the sheet 32 is designated as 38 and is disposed between the third designated 36 and the third designated as 40. Thus, the third designated 36 overlies one face of the middle third 38 while the third designated 40 is juxtaposed to the opposite face of the middle third 38.

While in the partially folded position as shown in FIG. 3, the sheet is then perforated so as to provide the rows of perforations 42, 44, 46, 48, 50, 52, etc. See FIG. 4. If desired, at the same time that such rows of perforations are applied, the middle of the sheet may be slit along a cut line 54. This produces two sheets having five rows of images, folded in thirds as shown in FIG. 3, and having four rows of perforations designated by the numerals 42, 44, 46 and 48.

Thereafter, the thusly folded and perforated sheet is folded in half along the fold line 56 and is thereafter again folded in half along the fold line 58. The strip 12 will then have only fold line 58 along one side edge. The other side edge of the strip 12 will have the two edges 60, 62 with fold line 35 therebetween as well as the fold lines 37, 56. At this point in time, the thusly folded sheet is preferably slit along line 54.

In the preferred embodiment of the invention as described above and shown in the drawings, the sheet 32 was initially 36 inches long and was utilized to produce two bookstrips 12 each comprised of five booklets interconnected with perforation lines. Each of such booklets is comprised of 24 pages, weighing approximately 1/64 ounce with the size of the pages being approximately 3 inches by $2\frac{1}{4}$ inches. The total thickness of each booklet when using 60 pound coated paper is only 0.045 inches. The booklets may be made from 50 pound offset paper whereby the booklet thickness is only 0.03 inches. The 60 pound paper is coated with clay in a conventional manner and enables the paper to be thinner than a conventional 60 pound paper which is uncoated. The clay coatings may include pigments if desired. In addition to adding weight to the paper, the clay coating provides a finish for good printing quality, smoothness, and for receipt of colored printing.

Since the bookstrip 12 has each of the booklets interconnected by the perforation lines, each booklet is capable of being exposed through a transparent face of the envelope 24 to improve the appearance of the product. Quite unexpectedly, the present invention reduced the cost of the product shown in FIG. 1 substantially over the cost of producing an envelope with five individual booklets processed in accordance with the above-mentioned applications by a factor of 35%. That is, package 10 is 35% cheaper to produce as compared with an envelope containing five individual booklets as described in the above-mentioned applications.

The slitting of the bookstrips 12 along line 54 is optionally performed at the time of applying the perforation lines or when the product has been completely folded as shown in FIG. 6. The perforation lines 42, 44, 46, 48, 50, 52, etc. must be applied after the sheet 32 has been folded in thirds if special custom designed and expensive perforating equipment is to be avoided. In order that the booklets are readily separable along the perforation lines and in order to avoid ragged edges, each perforation line is preferably comprised of a slit having a length of about $\frac{3}{8}$ inch with the integral tabs having a length of about 1/16 inch. Perforation lines constructed in this manner can be easily torn even by children, can be easily applied through three thickness of paper, does not significantly misalign as a result of the subsequent folding steps, and avoids an extremely ragged edge on the individual booklets after they have been separated from the strip.

While the above description sets forth a method of making booklets 10 high and slitting along line 54 to produce book strips 5 high, the invention is applicable to other production uses. For example, the method of the present invention may be used to produce booklets 5 high whereby the need for slitting the sheet longitudinally along line 54 is eliminated.

While the above description sets forth a method for making a book strip of 5 interconnected booklets having pages $3 \times 2\frac{1}{4}$ inches, the invention may be used to produce book strips having a different number of booklets such as 2, 3 or 4 interconnected booklets with different page sizes such as $3 \times 3\frac{3}{4}$ inches, or $3 \times 4\frac{1}{2}$ inches or $3 \times 5\frac{1}{2}$ inches, or $4 \times 5\frac{1}{2}$ inches.

The present invention may be embodied in other specific forms without departing from the spirit or essential attributes thereof and, accordingly, reference should be made to the appended claims, rather than to the foregoing specification as indicating the scope of the invention.

I claim:

1. An article of manufacture comprising a plurality of booklets interconnected end to end in the form of a bookstrip, each booklet being printed with different images on the pages thereof, said bookstrip having only fold lines along one edge and the pages thereof being free from any fasteners, said strip having fold lines and two free edges along the opposite edge thereof, said booklets being connected end to end and separable by perforation lines, said perforation lines including slits substantially longer than the length of the tabs interconnecting the booklets.

2. An article in accordance with claim 1 wherein said bookstrip is sealed within an envelope, said envelope having at least one major face thereof transparent so as to expose the first page of each booklet of said bookstrip.

3. An article in accordance with claim 1 wherein said perforation slits are approximately 6 times as long as the length of the interconnecting tabs.

4. An article in accordance with claim 1 wherein said strip is comprised of five interconnected booklets, an elongated envelope, said strip being disposed within said envelope, said envelope being sealed and having a tab, said tab containing a hole to facilitate mounting the tab for purposes of display, and said envelope having at least one transparent major face through which said bookstrip is visible.

5. An article in accordance with claim 1 wherein said bookstrip is formed from a sheet folded transversely into thirds in a manner so that a third of the sheet at one end overlies one face of the middle third of the sheet and the remaining third of the sheet is juxtaposed to the opposite face of the middle third of the sheet, and with the thusly folded sheet then being folded in half and then in half again.

6. A method comprising the steps of printing a plurality of rows of imprints on an elongated paper sheet, folding said printed sheet transversely into thirds so that a third of said sheet at one end overlies one face of the middle third of the sheet and the remaining third of the sheet is juxtaposed to the opposite face of the middle third of the sheet, then perforating the three layers of the thusly folded sheet between said rows of imprints with perforation slits substantially longer than the integral tabs, and then folding the folded perforated sheet in half, then folding the folded perforated sheet in half again, to thereby provide a strip of booklets interconnected by said tabs with pages of the same size without the use of fasteners and only fold lines along one edge of said strip, then introducing the thusly folded strip of booklets into an envelope slightly longer than said strip, and sealing said envelope.

7. A method in accordance with claim 6 including using elongated envelopes open at one end and which are made of a polymeric plastic material having at least one transparent major face, and said sealing step including sealing said open end of said envelope.

8. A method in accordance with claim 6 wherein said printing step produces X rows of imprints, longitudinally slitting the sheet after the last-mentioned folding step so as to provide X/2 strips each having a plurality of booklets interconnected by said tabs, and wherein X is an even whole number.

9. A method in accordance with claim 6 including the step of longitudinally slitting said folded sheet simultaneous with said step of perforating said sheet in a manner so that the perforations are spaced from and parallel to said slit.

10. A method in accordance with claim 6 including producing by said folding steps booklets having dimensions of approximately 3 to 4 inches long and 2½ to 5½ inches high and interconnected by said tabs on their longest side to the next adjacent booklet of the strip.

* * * * *